US011676526B2

(12) United States Patent
Hai

(10) Patent No.: US 11,676,526 B2
(45) Date of Patent: Jun. 13, 2023

(54) METHODS FOR VERIFYING AND IMPROVING ANGULAR COLOR SHIFT IMPACT FACTORS

(71) Applicant: Shenzhen China Star Optoelectronics Semiconductor Display Technology Co., Ltd., Guangdong (CN)

(72) Inventor: Bo Hai, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 430 days.

(21) Appl. No.: 17/046,797

(22) PCT Filed: Jul. 9, 2020

(86) PCT No.: PCT/CN2020/101025
§ 371 (c)(1),
(2) Date: Oct. 12, 2020

(87) PCT Pub. No.: WO2021/253530
PCT Pub. Date: Dec. 23, 2021

(65) Prior Publication Data

US 2023/0106498 A1 Apr. 6, 2023

(30) Foreign Application Priority Data

Jun. 16, 2020 (CN) ..... 202010548309.X

(51) Int. Cl.
*G09G 3/20* (2006.01)

(52) U.S. Cl.
CPC ... *G09G 3/2074* (2013.01); *G09G 2300/0452* (2013.01); *G09G 2320/0242* (2013.01); *G09G 2320/0673* (2013.01); *G09G 2320/0693* (2013.01); *G09G 2360/16* (2013.01)

(58) Field of Classification Search
CPC ..... G09G 3/2074; G09G 2300/0452; G09G 2320/0242; G09G 2320/0673; G09G 2320/0693; G09G 2360/16
See application file for complete search history.

(56) References Cited

U.S. PATENT DOCUMENTS

| | | | | |
|---|---|---|---|---|
| 9,734,750 | B2 * | 8/2017 | Chen | G09G 3/2074 |
| 2008/0278433 | A1 | 11/2008 | Lee et al. | |
| 2012/0086743 | A1 * | 4/2012 | Shiomi | G02F 1/13624 345/694 |
| 2014/0218411 | A1 * | 8/2014 | Chen | G09G 3/3611 345/88 |
| 2018/0174535 | A1 * | 6/2018 | Chen | G09G 3/3611 |

FOREIGN PATENT DOCUMENTS

| | | |
|---|---|---|
| CN | 102568429 | 7/2012 |
| CN | 109147712 | 1/2019 |
| KR | 10-2016-0081698 | 7/2016 |

* cited by examiner

*Primary Examiner* — Ricardo Osorio

(57) ABSTRACT

Methods for verifying and improving angular color shift impact factors are provided. Experiments have verified that angular color shift can be effectively improved by downgrading gray levels of red and green subpixels, while downgrading gray levels of blue subpixels may deteriorate the angular color shift.

20 Claims, 5 Drawing Sheets

METHODS FOR VERIFYING AND IMPROVING ANGULAR COLOR SHIFT IMPACT FACTORS

RELATED APPLICATIONS

This application is a National Phase of PCT Patent Application No. PCT/CN2020/101025 having International filing date of Jul. 9, 2020, which claims the benefit of priority of Chinese Patent Application No. 202010548309.X filed on Jun. 16, 2020. The contents of the above applications are all incorporated by reference as if fully set forth herein in their entirety.

FIELD AND BACKGROUND OF THE INVENTION

The disclosure relates to displays, and particularly to methods for verifying and improving chroma view angle impact factors.

Angular brightness loss is an important factor in liquid crystal display (LCD) panels. Higher angular brightness loss leads to lower off-axis luminance degradation. Since human eyes are sensitive to luminance, a high off-axis luminance brings more visual satisfactions. With leaping developments in technologies, requirements for angular brightness loss from clients are also progressively increasing.

LCD devices such as LCD TV have been widely used. Current LCD devices are categorized into three types: Twisted-Nematic/Super-Twisted-Nematic (TN/STN) type, In-Plane-Switching (IPS) type, and Vertical-Alignment (VA) type. Common display modes in LCD TVs include TN, IPS, and VA, respectively, each characterized with different advantages and disadvantages. The VA display mode is a popular display mode in TFT-LCDs used in large size LCD TVs as it has substantially higher contrast ratio over the IPS display mode, fast response time, and zero requirement for a rubbing alignment process. However, view angle features are worse than the IPS display mode. An off-axis image quality is so low that an improvement is desired. Various tint correction technologies are developed for the VA type LCD panels, such as mitigating color tints through LCD cells designed in 4-domain or 8-domain structures.

When LCD panels are delivered for a client verification process, there are usually a lot of requirements on view angles. The VA type LCD panels are known to have color wash out issues, therefore improvements are desirable in the face of the high standard view angle requirements from the clients.

To improve a manufacturing process for the LCD panels, however, is challenging and raises concerns of cost increase and yield rate loss. There is a need to effectively improve the client's view angle specifications while reducing the cost and implementation time to rapidly achieve the client's view angle requirements.

Concerning disadvantages and deficiencies in conventional techniques, methods for verifying angular color shift impact factors and improving angular color shift are proposed according to embodiments of the present disclosure, being capable of locating the factors that impact the angular color shift from the optical verification code without manipulating the manufacturing process of the liquid crystal display panels, and achieving cost reduction as well as rapidly catching up the client's view angle requirements through optical code adjustments.

SUMMARY OF THE INVENTION

A detailed description is given in the following embodiments with reference to the accompanying drawings.

Embodiments of the disclosure provides a method for verifying angular color shift impact factors, comprising the following steps.

Tristimulus values are measured as raw data at an on-axis view angle and an off-axis view angle of a display panel where gray levels of red/green/blue subpixels are at a maximum gray level when a white balance (WB) code is disabled.

Four WB conditions are defined for the WB code. In a first condition, gray levels of all red/green/blue subpixels are not downgraded, that is, gray levels of the red/green/blue subpixels in the display panel are all at the maximum gray level. In a second condition, only a gray level of a red subpixel is downgraded, that is, the gray level of the red subpixel in the display panel is downgraded by a first value, whereas gray levels of green and blue subpixels are at the maximum gray level. In a third condition, only a gray level of a green subpixel is downgraded, that is, the gray level of the green subpixel in the display panel is downgraded by the first value, whereas gray levels of red and blue subpixels are at the maximum gray level. In a fourth condition, only a gray level of a blue subpixel is downgraded, that is, the gray level of the blue subpixel in the display panel is downgraded by the first value, whereas gray levels of red and green subpixels are at the maximum gray level.

Brightness levels and chromaticities of a white image displayed on the display panel are measured at the on-axis view angle respectively under the four WB conditions.

Experimental WB codes corresponding to each gray level of the display panel are calculated based on chromaticity of each gray level at the on-axis view angle of a white image displayed on the display panel in a same principle as deriving a Gamma curve 2.2 when the display panel displays the white image.

Experimental tristimulus values at the on-axis view angle and the off-axis view angle are calculated according to the experimental WB codes;

Based on the experimental tristimulus values, chromas corresponding to each view angle are calculated when the display panel displays an image.

The angular color shifts corresponding to each view angle are calculated when the display panel displays the image.

In an embodiment, the maximum gray level is but not limited to 128.

In another embodiment, the maximum gray level is but not limited to 255.

Furthermore, the first value may be but not limited to one of the following numbers: 10, 15, 20, 25, 30, 35, 40, 45, 50, and 55.

The on-axis/off-axis view angle is an included angle between an on-axis/off-axis direction and a normal vector respective to the display panel, ranging from +90 degrees to −90 degrees.

In a further embodiment, the values of the off-axis view angle comprise ±15 degrees, and ±30 degrees, ±45 degrees, and ±60 degrees.

Embodiments of the disclosure further provides a method for improving angular color shifts, as shown in the following steps.

A white balance (WB) code is configured to one of the WB conditions: gray levels of green and blue subpixels are maintained while a gray level of a red subpixel is downgraded; gray levels of red and blue subpixels are maintained while a gray level of a green subpixel is downgraded; a gray level of a blue subpixel is maintained while gray levels of red and green subpixels are downgraded.

At an on-axis view angle of a display panel under one of the configured WB conditions, brightness levels and chromaticities of a white image displayed on the display panel are measured.

Experimental WB codes corresponding to each gray level of the display panel are calculated based on chromaticity of each gray level of at the on-axis view angle of a white image displayed on the display panel in a same principle as deriving a Gamma curve 2.2 when the display panel displays the white image.

According to the experimental WB code, experimental tristimulus values at the on-axis view angle and an off-axis view angle of the display panel are calculated.

Based on the experimental tristimulus values, chromas corresponding to each view angle are calculated when the display panel displays an image, including an on-axis chroma and an off-axis chroma.

The angular color shifts corresponding to each view angle are calculated and output when the display panel displays the image. Wherein each angular color shift is a ratio of an off-axis chroma to an on-axis chroma per view angle.

When configuring the WB code to one of the WB conditions, the gray levels of the red and green subpixels are downgraded by a range of 1 to 50 levels.

In an embodiment, the maximum gray level is but not limited to 128. In another embodiment, the maximum gray level is but not limited to 255.

Furthermore, the first value may be but not limited to one of the following numbers: 10, 15, 20, 25, 30, 35, 40, 45, 50, and 55.

The on-axis/off-axis view angle is an included angle between an on-axis/off-axis direction and a normal vector respective to the display panel, ranging from +90 degrees to −90 degrees.

In a further embodiment, the values of the off-axis view angle comprise ±15 degrees, and ±30 degrees, ±45 degrees, and ±60 degrees.

The described embodiments have several advantages. The proposed methods for verifying and improving angular color shift impact factors can verify how the optical codes affect the angular color shifts without manipulating liquid crystal display panel manufacturing processes, confirm impact factors in the optical codes that affect the angular color shifts, and improve the client's view angle specification by adjusting the optical codes. The total cost is reduced, and the client's demands are rapidly satisfied.

BRIEF DESCRIPTION OF THE SEVERAL VIEWS OF THE DRAWINGS

The invention can be more fully understood by reading the subsequent detailed description and examples with references made to the accompanying drawings, wherein.

DESCRIPTION OF SPECIFIC EMBODIMENTS OF THE INVENTION

The following paragraphs encompassed with the drawings provide detailed and complete descriptions of the proposed embodiments in the subject application. It is apparent that the described embodiments is merely a portion of possible solutions and is not intended to exclude other possible embodiments not described herein. Any alternative solutions based on the same principle of operations described without creative endeavors are deemed to be under protection of the scope of the subject application.

All steps described in the embodiments can be executed in any properly arranged order unless the context specifically suggests otherwise. Any alternations can be made not just to the order of steps. All the demonstrative or illustrative languages in the description, (i.e., such as, for example), unless verbally suggested otherwise, are merely for better understanding of the inventive concepts, but not for limitation of the claimed scopes. People skill in the art will be able to easily adapt and modify the concept of the disclosed embodiments without departing from the spirit and scopes of the disclosure.

To be further noticed, in some alternative embodiments, the steps can be executed without fixed orders. For example, two steps can be executed at the same time, or sometimes executed in a reversed order.

Embodiments of the disclosure will be introduced in detail encompassed with drawings. Implementations of the disclosed idea can be presented in different forms in addition to the embodiments described in the application. The embodiments proposed are merely for explanation of possible applications in practice, so that people skilled in the area can fully comprehend the ideas delivered herein and adapt to any modification of specific applications with expectable effects.

Figure 1:
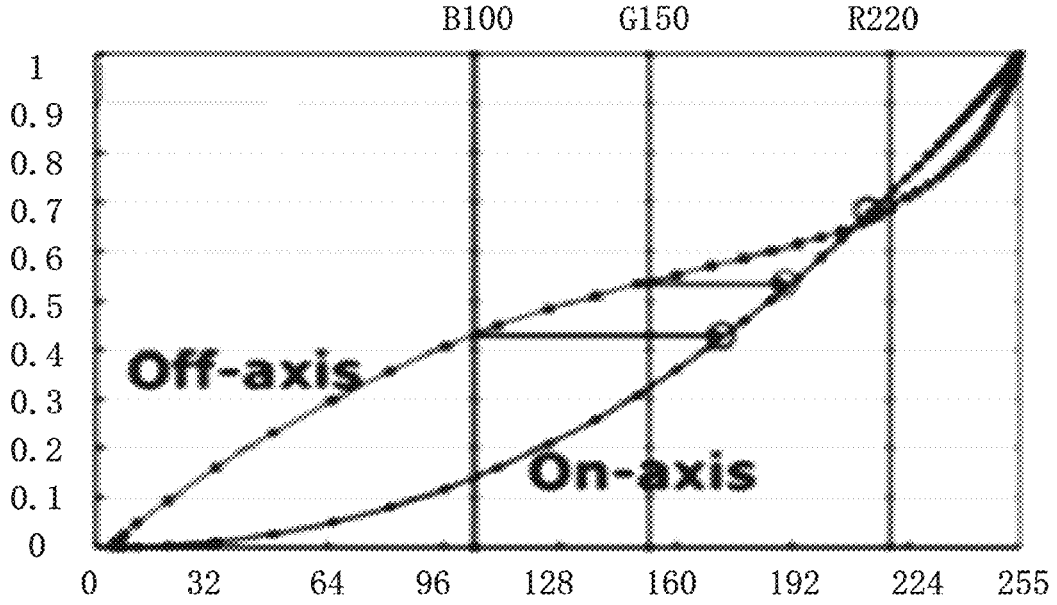
FIG. 1 is a diagram showing a root cause of angular color shifts in a liquid crystal display (LCD) panel.

In the process of client's quality verification conducted on the vendor's LCD panels, clients often have requirements on view angles. The VA type LCD panel is known to suffer from color wash out issues, that is, color shifts at off-axis view angles of an LCD panel. The root cause of off-axis color shifts is shown in FIG. 1, in which the horizontal axis denotes gray levels, and the vertical axis is a standardized brightness level (normalized luminance). Red, green, and blue subpixels are symbolized as R, G, and B. It is shown that an off-axis Gamma curve is discrepant from an on-axis Gamma curve. Bigger discrepancy between the two curves in horizontal axis renders worse image quality at the off-axis view angle. Considering a skin color image as an example, the skin color composition at the on-axis view angle comprises R220, G150, and B100 according to the on-axis Gamma curve. At the off-axis view angle, however, the skin color turns into a composition of R215, G192, and B176 according to the off-axis Gamma curve. It is shown that the discrepancies between the two curves are bigger for lower gray levels. A yellow skin color may turn whiteish at the off-axis angle, rendering unsatisfactory image quality.

A method was once proposed to evaluate the color shifts between the off-axis view angle and the on-axis view angle.

$$D_C=C_{OFF}/C_{ON},$$

Where C denotes chroma in a cylindrical coordinate system (also known as relative saturation in different color systems), CUFF denotes chroma observed at the off-axis view angle of an LCD panel, $C_{ON}$ denotes chroma observed at the on-axis view angle of the LCD panel, and $D_C$ denotes an angular color shift corresponding to the off-axis view angle, that is, a ratio of $C_{OFF}$ to $C_{ON}$.

Figure 2:
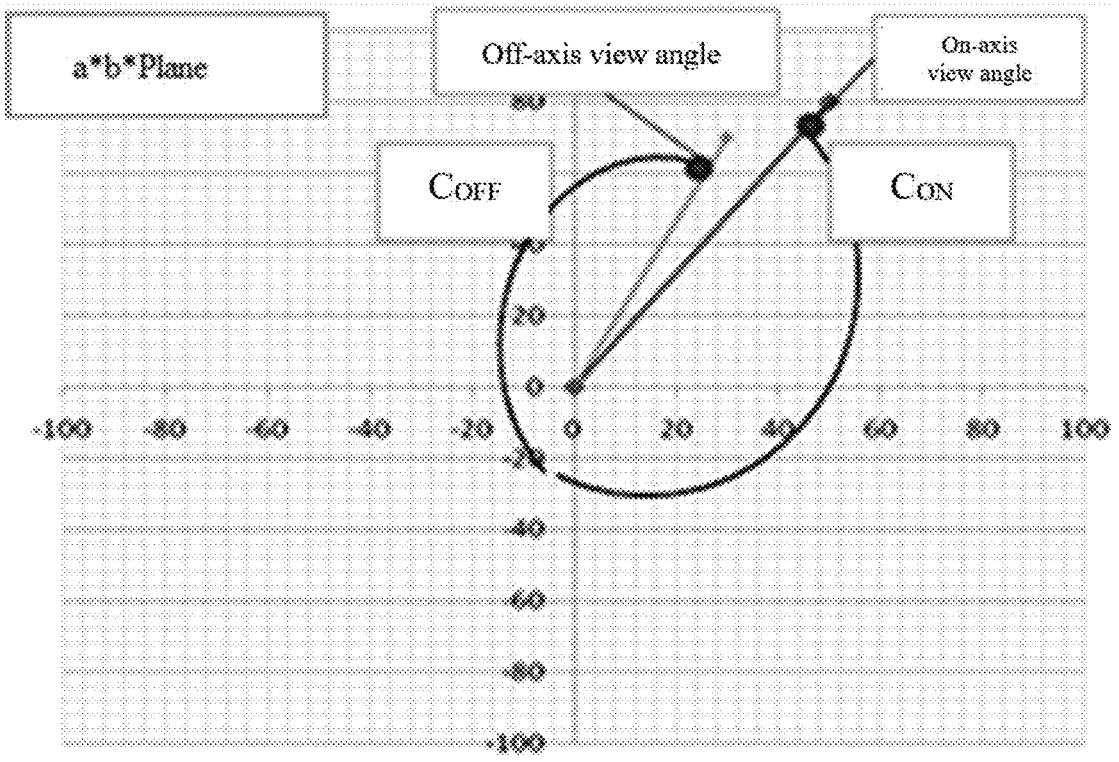
FIG. 2 is a diagram illustrating measurement of chromaticity in a lab system.

As shown in FIG. 2, the chroma C is defined in CIE 1976 Lab: $C=(a^2+b^2)^{0.5}$.

In an embodiment, compositions of different skin colors are defined in the following table for the angular color shift Dc evaluation:

| Colors | R | G | B |
|---|---|---|---|
| Skin2 | 133 | 101 | 75 |
| Skin4 | 192 | 156 | 129 |
| Skin5 | 186 | 161 | 143 |
| Skin6 | 211 | 153 | 126 |

Embodiments hereafter describe methods for verifying and improving angular color shift impact factors, which can verify how the optical codes affect the angular color shifts without manipulating liquid crystal display panel manufacturing processes, confirm impact factors in the optical codes that affect the angular color shifts, and improve the client's view angle specification by adjusting the optical codes. The total cost is reduced, and the client's demands are rapidly satisfied.

Figure 3:
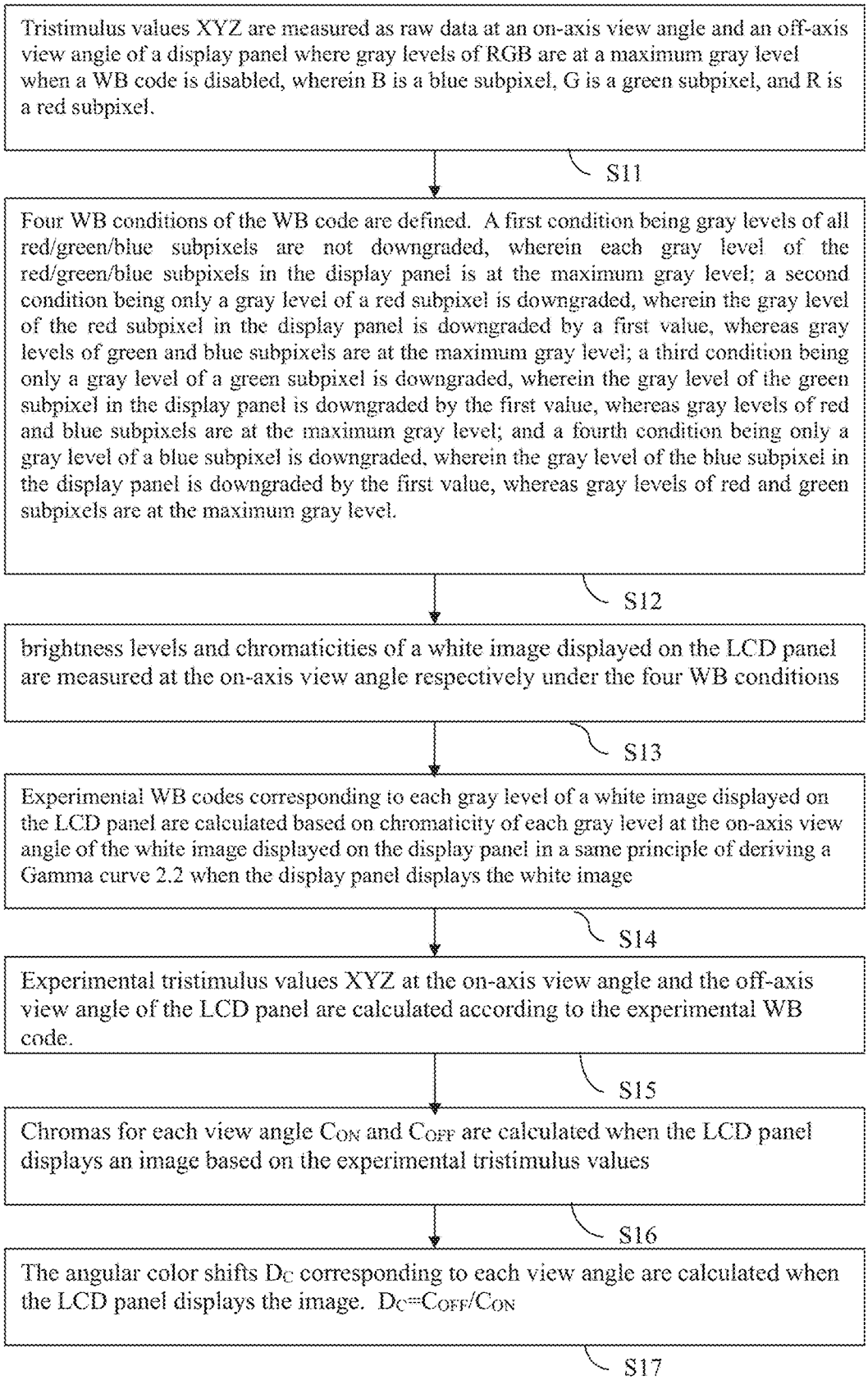
FIG. 3 is a flowchart of a method for verifying impact factors of angular color shifts caused by optical codes according to an embodiment of the present disclosure.

As shown in FIG. 3, a method for verifying angular color shift impact factors comprise following steps S11-S17.

S11, tristimulus values XYZ are measured as raw data at an on-axis view angle (0 degree) and an off-axis view angle of an LCD panel where gray levels (0-255 levels) of WRGB are at a maximum gray level when a white balance (WB) code is disabled.

Wherein, W is white subpixel, B is a blue subpixel, G is a green subpixel, and R is a red subpixel. W does not actually affect the image color, and gray levels of RGB are optically added up to present a white image on the LCD panel. White balance is an indication describing the accuracy of a white mixture from the R, G, B primary colors. It is known that a mixture of the RGB components in different gray levels can literally render any color/gray level in the LCD panel, and WB adjustment can be implemented by tuning the percentage of RGB gray levels. The basic principle of WB adjustment comprises brightness curve, a.k.a. the Gamma 2.2 curve; and a gray level chroma curve in which gray levels of each chromaticity xy is identical to the maximum gray level.

It is known that in an RGB color system, the gray level of each color is referred to as both brightness and chromaticity xy. The tristimulus values XYZ is a color system based on the extent of stimulations on human retina caused by the three primary colors.

In the tristimulus color system, the amount of stimulations are presented in X (red stimulus), Y (green stimulus), and Z (blue stimulus). The tristimulus values XYZ can be converted to the chromaticity xy:

$$x=\frac{X}{X+Y+Z},\ y=\frac{Y}{X+Y+Z}$$

The on-axis/off-axis view angle is an included angle between an on-axis/off-axis direction and a normal vector respective to the LCD panel, ranging from +90 degrees to −90 degrees. Specifically, the on-axis view angle is exactly 0 degree, and the off-axis view angle may range variously in different embodiments. For example, the off-axis view angle can range from ±15 degrees, ±30 degrees, ±45 degrees, and ±60 degrees, or preferably 15, 30, 45 and 60 degrees.

S12, four WB conditions of the WB code are defined.

In a first condition, gray levels of all RGB subpixels are not downgraded, wherein gray levels of the RGB subpixels in the LCD panel are all at the maximum gray level.

In a second condition, only a gray level of R subpixels is downgraded, that is, the gray level of R subpixels in the LCD panel is downgraded by a first value, whereas gray levels of GB subpixels are at the maximum gray level.

In a third condition, only a gray level of G subpixels is downgraded, that is, the gray level of G subpixels in the LCD panel is downgraded by the first value, whereas gray levels of RB subpixels are at the maximum gray level.

In a fourth condition, only a gray level of B subpixels is downgraded, that is, the gray level of B subpixels in the LCD panel is downgraded by the first value, whereas gray levels of RG subpixels are at the maximum gray level.

For better illustration, a table is shown below as an example, where a maximum gray level is 255, and a first value is 20. The WB code is a value of 255 levels in the embodiment, and the maximum gray level is not limited to be 255, but may be 128 or other values.

| Code No | WB Conditions | R | G | B |
|---|---|---|---|---|
| 1 | No downgrade | 255 | 255 | 255 |
| 2 | R downgraded by 20 | 235 | 255 | 255 |
| 3 | G downgraded by 20 | 255 | 235 | 255 |
| 4 | B downgraded by 20 | 255 | 255 | 235 |

S13, brightness levels and chromaticities of a white image displayed on the LCD panel are measured at the on-axis view angle respectively under the four WB conditions.

S14, experimental WB codes corresponding to each gray level of a white image displayed on the LCD panel are calculated based on on-axis chroma of each gray level of the white image displayed on the display panel in a same principle of deriving a Gamma curve 2.2 when the display panel displays the white image.

Specifically, Gamma is known as a luminance response of a display, presented as $L_G=L_{255}*(G/255)^{gamma}$; a gamma curve is a non-straight curve because the correlations between luminance and input data are not uniformly distributed. Gamma curves of different display devices feature different characteristics, which usually require a calibration in the manufacturing process known as a Gamma correction, so that the outputs of different display devices can be standardized in response to the same input data.

Three Gamma curves each corresponding to R, G, and B subpixels can be individually adjusted to optimize the displayed image, and such an approach is referred to as a tri-gamma correction. The tri-gamma correction generally can achieve satisfying gray level transition and colorfulness presentation.

S15, experimental tristimulus values XYZ at the on-axis view angle and the off-axis view angle of the LCD panel are calculated according to the experimental WB code. That is, new tristimulus values XYZ corresponding to the skin colors Skin2, Skin4, Skin5, and Skin6 at the on-axis view angle (0 degree) and the off-axis view angle (large degrees) are calculated.

S16, based on the experimental tristimulus values, chromaticities xy corresponding to each view angle are calculated when the LCD panel displays an image. Specifically, the on-axis chroma $C_{ON}$ and the off-axis chroma $C_{OFF}$ of each skin color are calculated. The color coordinates of CIE 1976 L*a*b* are calculated by the formulae:

$$\begin{cases} L^* = 116(Y/Y_0)^{1/3} - 16 \\ a^* = 500\left[(X/X_0)^{1/3} - (Y/Y_0)^{1/3}\right] \\ b^* = 200\left[(Y/Y_0)^{1/3} - (Z/Z_0)^{1/3}\right] \end{cases}$$

Wherein, $Y/Y_0>0.01$; X, Y, Z are tristimulus values of a target illuminant; $X_0$, $Y_0$, $Z_0$ tristimulus values of a CIE standard illuminant; L* is the perceptual lightness; a* and b* are the perceptual chromaticity components in the CIELAB color space.

By substituting the brightness and the chromaticity into the formula $C=(a^2+b^2)$, the on-axis chroma $C_{ON}$ and the off-axis chroma $C_{OFF}$ of each skin color are calculated from the experimental tristimulus values XYZ.

S17, the angular color shifts $D_C$ corresponding to each view angle are calculated when the LCD panel displays the image. Each angular color shift $D_C$ is a ratio of an off-axis chroma $C_{OFF}$ to an on-axis chroma $C_{ON}$ per view angle, that is, $D_C=C_{OFF}/C_{ON}$. The calculation of angular color shifts $D_C$ is therefore based the equation. Experiments shows that the angular color shifts $D_C$ generated from conditions 2 and 3 where only R or G are downgraded are significantly improved. The angular color shift $D_C$ generated from condition 4 where only B is downgraded, however, are significantly deteriorated.

Diagrams of angular color shifts impact curves presenting the influences on the skin colors under various WB conditions are illustrated as a comparison for easy understanding of the results.

Figure 4:
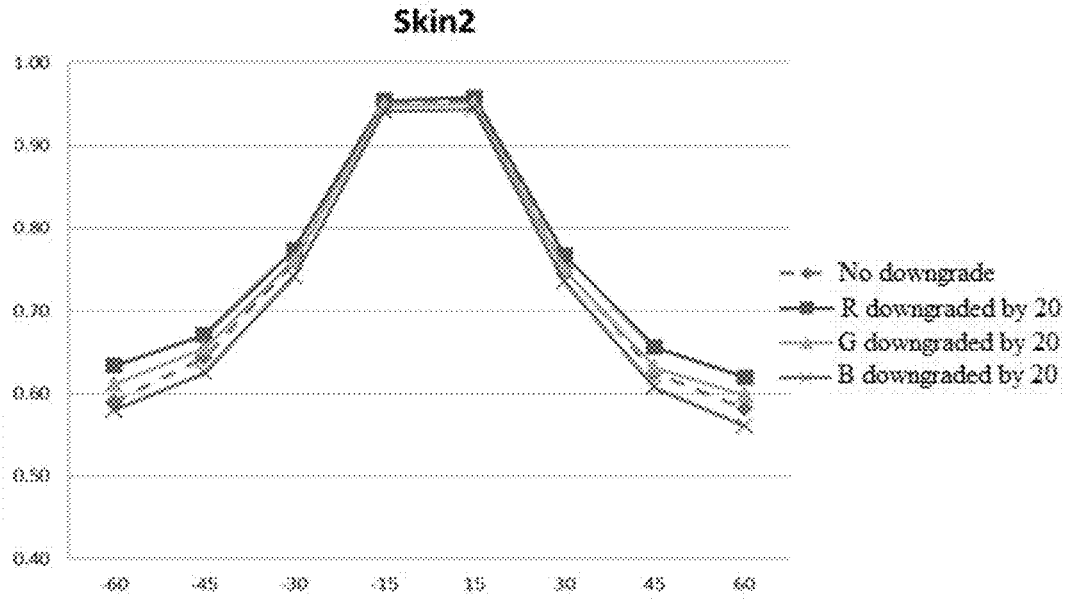
FIG. 4 is a diagram showing comparative angular color shifts impact curves of skin color 2 (SKIN2) under four conditions in a WB code of level 255 corresponding to each view angle.
Figure 5:
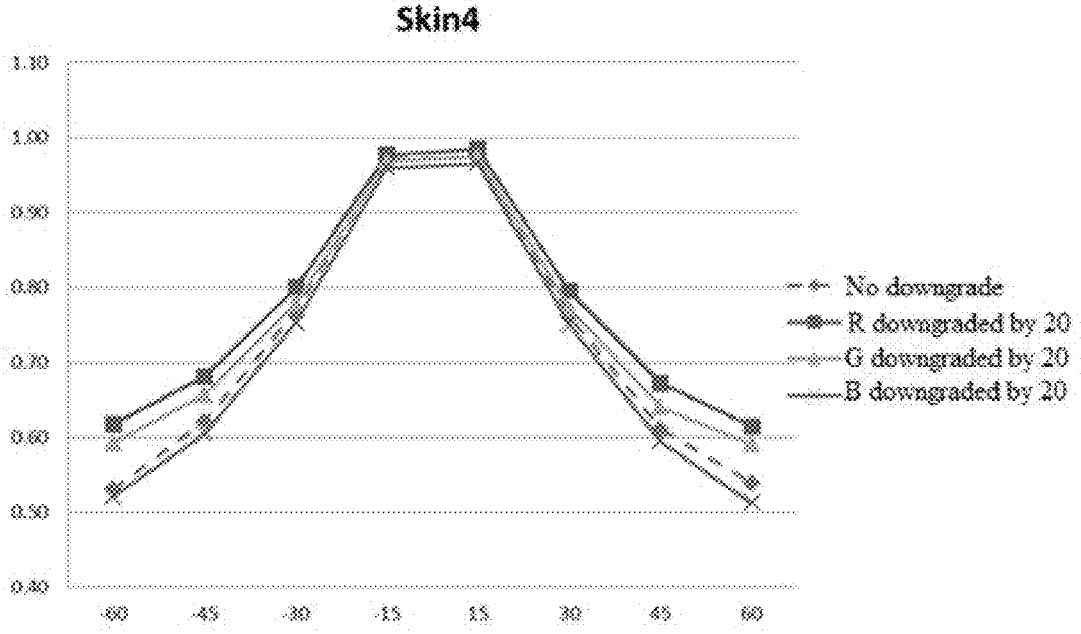
FIG. 5 is a diagram showing comparative angular color shifts impact curves of skin color 4 (SKIN4) under four conditions in the WB code of level 255 corresponding to each view angle.
Figure 6:
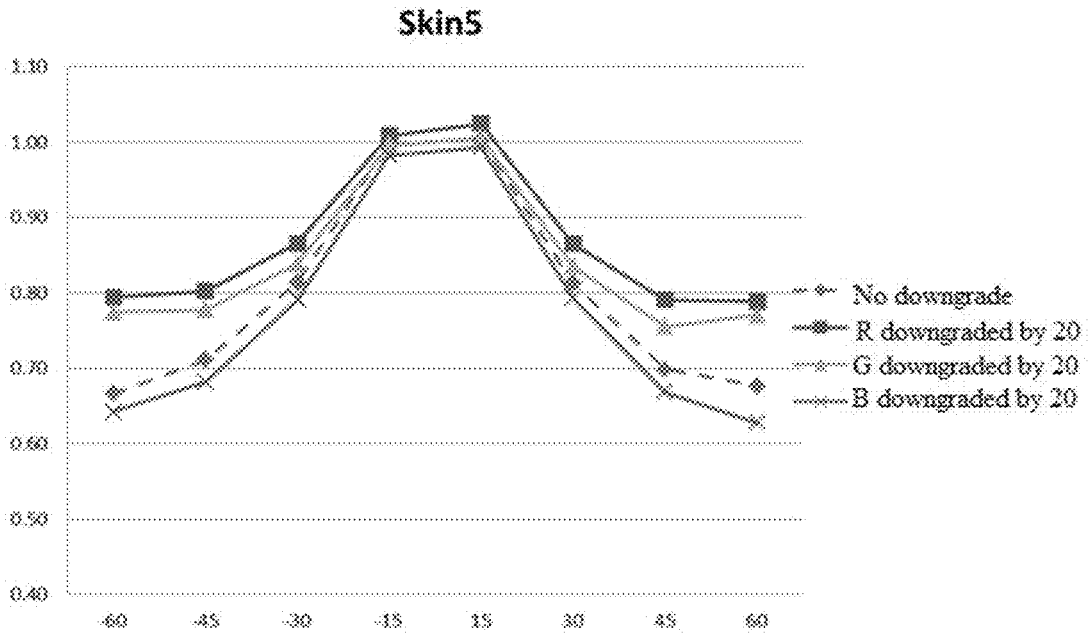
FIG. 6 is a diagram showing comparative angular color shifts impact curves of skin color 5 (SKINS) under four conditions in the WB code of level 255 corresponding to each view angle.
Figure 7:
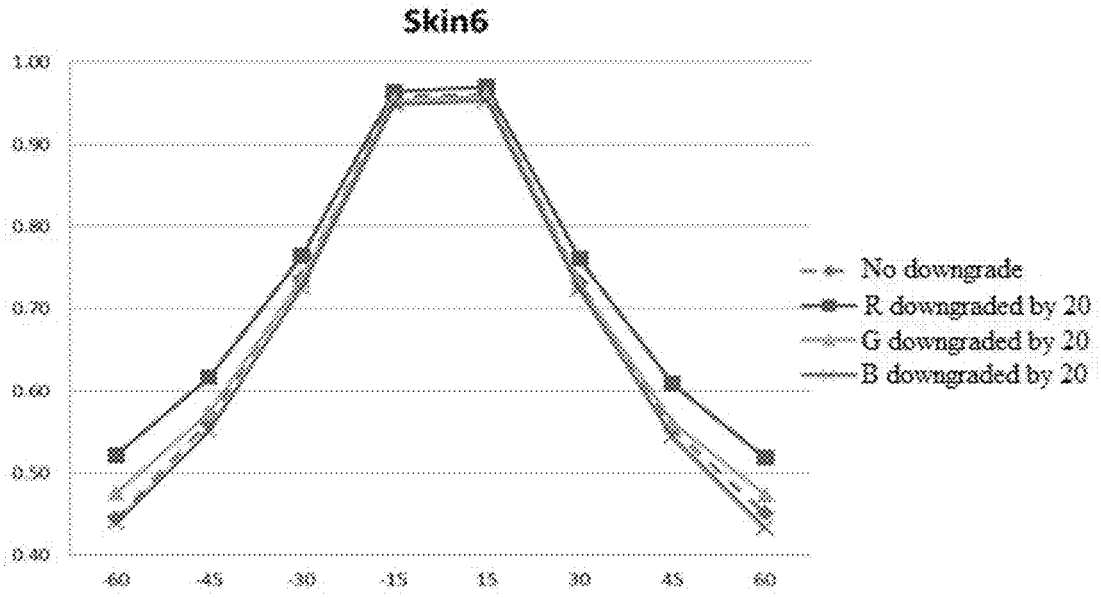
FIG. 7 is a diagram showing comparative angular color shifts impact curves of skin color 6 (SKIN6) under four conditions in the WB code of level 255 corresponding to each view angle.

FIGS. 4-7 are diagrams showing comparative angular color shifts impact curves of skin colors (Skin2-Skin6) under four conditions in a WB code of level 255 corresponding to each view angle. FIG. 4 is a diagram showing comparative angular color shifts impact curves of skin color 2 (Skin2) under four conditions in a WB code of level 255 corresponding to each view angle. FIG. 5 is a diagram showing comparative angular color shifts impact curves of skin color 4 (Skin4) under four conditions in a WB code of level 255 corresponding to each view angle. FIG. 6 is a diagram showing comparative angular color shifts impact curves of skin color 5 (Skin5) under four conditions in a WB code of level 255 corresponding to each view angle. FIG. 7 is a diagram showing comparative angular color shifts impact curves of skin color 6 (Skin6) under four conditions in a WB code of level 255 corresponding to each view angle. The horizontal axis is gray level, and the vertical axis is brightness level. Through comparison of the curves, it is observed that the angular color shifts Dc in conditions 2 and 3 where only R or G are downgraded have the greatest improvement. The angular color shift Dc generated from condition 4 where only B is downgraded, however, are significantly deteriorated.

Through the calculations and diagram comparisons described, influences on the angular color shift DC caused by the four WB conditions can be obviously observed. A method for improving the angular color shift DC by adjusting the optical code is proposed, based on comparisons of the influences on the angular color shift DC caused by the four WB conditions.

Figure 8:
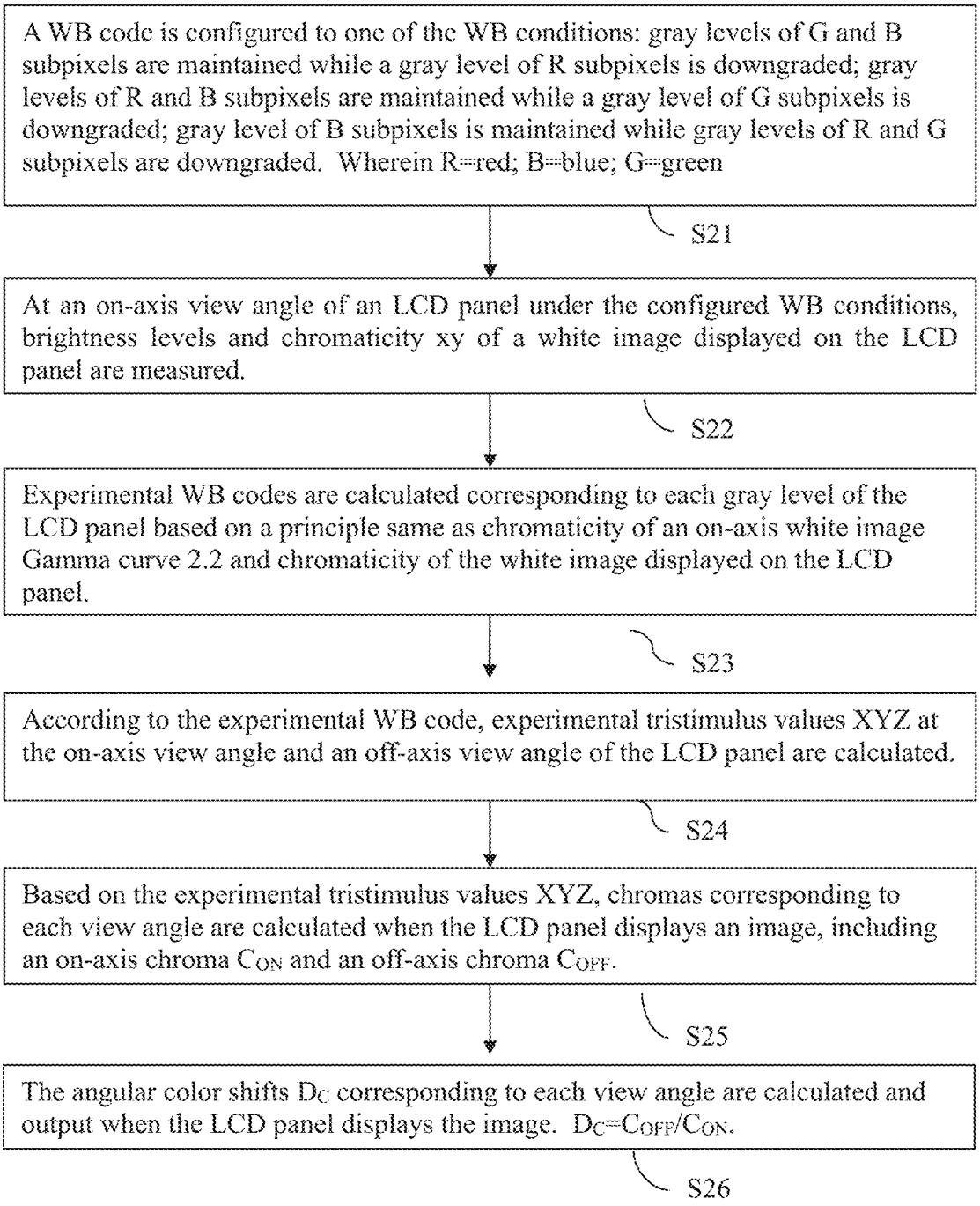
FIG. 8 is a flowchart of a method for improving angular color shifts according to an embodiment of the present disclosure.

Referring to FIG. 8, specifically, a method for improving angular color shifts is summarized in steps S21-S26 in the flowchart.

S21, a white balance (WB) code is configured to one of the WB conditions: gray levels of G and B subpixels are maintained while a gray level of R subpixels is downgraded; gray levels of R and B subpixels are maintained while a gray level of G subpixels is downgraded; gray level of B subpixels is maintained while gray levels of R and G subpixels are downgraded.

S22, at an on-axis view angle of an LCD panel under the configured WB conditions, brightness levels and chromaticity xy of a white image displayed on the LCD panel are measured.

S23, experimental WB codes are calculated corresponding to each gray level of the LCD panel based on a principle same as chromaticity of an on-axis white image Gamma curve 2.2 and chromaticity of the white image displayed on the LCD panel.

S24, according to the experimental WB code, experimental tristimulus values XYZ at the on-axis view angle and an off-axis view angle of the LCD panel are calculated.

S25, based on the experimental tristimulus values XYZ, chromas corresponding to each view angle are calculated when the LCD panel displays an image, including an on-axis chroma $C_{ON}$ and an off-axis chroma $C_{OFF}$.

S26, the angular color shifts Dc corresponding to each view angle are calculated and output when the LCD panel displays the image. Each angular color shift Dc is a ratio of an off-axis chroma $C_{OFF}$ to an on-axis chroma $C_{ON}$ per view angle, that is, $D_C=C_{OFF}/C_{ON}$.

In step S10, when configuring the WB code to one of the WB conditions, the gray levels of the R and B subpixels are downgraded by a range of 1 to 50 levels.

The maximum gray level is but not limited to 255. The on-axis/off-axis view angle is an included angle between an on-axis/off-axis direction and a normal vector respective to the LCD panel, ranging from +90 degrees to −90 degrees. The values of the off-axis view angle comprise ±15 degrees, and ±30 degrees, ±45 degrees, and ±60 degrees. Specifically, the on-axis view angle is exactly 0 degree, and the off-axis view angles are preferably 15, 30, 45 and 60 degrees.

The described method for improving the angular color shifts $D_C$ can be summarized as following methods 1-3.

Method 1: the gray levels of G and B subpixels in the WB code are maintained, whereas only the gray level of R subpixel is downgraded. Specifically, a gray level of a subpixel R255 (R at gray level 255) is reduced (downgraded) to be a WB code corresponding to the subpixel R255, while G and B subpixels remain unchanged. Thereafter, a brightness level and chromaticity xy are measured at the on-axis (0 degree) view angle. The same principle for deriving an on-axis (0 degree) Gamma 2.2 can be applied on chromaticity xy of each gray level and chromaticity xy of level 255 to recalibrate a series of experimental WB codes each corresponding to a gray level to improve the angular color shifts $D_C$. The ranges of gray levels that the R subpixel is downgraded are 1-50, that is, the ranges of gray levels in the WB code corresponding to R255 are 254-205.

Method 2: the gray levels of R and B subpixels in the WB code are maintained, whereas only the gray level of G subpixel is downgraded. Specifically, a gray level of a subpixel G255 (G at gray level 255) is reduced (downgraded) to be a WB code corresponding to the subpixel G255, while R and B subpixels remain unchanged. Thereafter, a brightness level and chromaticity xy are measured at the on-axis (0 degree) view angle. The same principle for deriving an on-axis (0 degree) Gamma 2.2 can be applied on chromaticity xy of each gray level and chromaticity xy of level 255 to recalibrate a series of experimental WB codes each corresponding to a gray level to improve the angular color shifts Dc. The ranges of gray levels that the G subpixel is downgraded are 1-50, that is, the ranges of gray levels in the WB code corresponding to G255 are 254-205.

Method 3: the gray level of B subpixel in the WB code are maintained, whereas only the gray levels of R and G subpixels are downgraded. Specifically, a gray level of a subpixel R255 and G255 are reduced (downgraded) to be WB codes corresponding to the subpixels R255 and G255, while the B subpixel remains unchanged. Thereafter, a brightness level and chromaticity xy are measured at the on-axis (0 degree) view angle. The same principle for deriving an on-axis (0 degree) Gamma 2.2 can be applied on chromaticity xy of each gray level and chromaticity xy of level 255 to recalibrate a series of experimental WB codes each corresponding to a gray level to improve the angular color shifts Dc. The ranges of gray levels that the R and G subpixels are downgraded are 1-50, that is, the ranges of gray levels in the WB code corresponding to R255 and G255 are 254-205.

The proposed methods for verifying and improving angular color shift impact factors are advantageous for the capabilities of verifying how the optical codes affect the angular color shifts without manipulating liquid crystal LCD panel manufacturing processes, confirming impact factors in the optical codes that affect the angular color shifts, and improving the client's view angle specification by adjusting the optical codes. The total cost is reduced, and the client's demands are rapidly satisfied.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A method for verifying angular color shift impact factors, comprising following steps:

measuring tristimulus values as raw data at an on-axis view angle and an off-axis view angle in a display panel, where gray levels of red/green/blue subpixels are at a maximum gray level when a white balance (WB) code is disabled;

defining four WB conditions for the WB code, comprising:

a first condition being gray levels of all red/green/blue subpixels are not downgraded, wherein each gray level of the red/green/blue subpixels in the display panel is at the maximum gray level;

a second condition being only a gray level of a red subpixel is downgraded, wherein the gray level of the red subpixel in the display panel is downgraded by a first value, whereas gray levels of green and blue subpixels are at the maximum gray level;

a third condition being only a gray level of a green subpixel is downgraded, wherein the gray level of the green subpixel in the display panel is downgraded by the first value, whereas gray levels of red and blue subpixels are at the maximum gray level; and a fourth condition being only a gray level of a blue subpixel is downgraded, wherein the gray level of the blue subpixel in the display panel is downgraded by the first value, whereas gray levels of red and green subpixels are at the maximum gray level;

measuring, at the on-axis view angle, brightness levels and chromaticities of a white image displayed on the display panel respectively under the four WB conditions;

calculating experimental WB codes corresponding to each gray level of the display panel;

calculating experimental tristimulus values at the on-axis view angle and the off-axis view angle according to the experimental WB codes;

calculating, based on the experimental tristimulus values, chromas corresponding to each view angle when the display panel displays an image; and calculating angular color shifts corresponding to each view angle when the display panel displays the image.

2. The method for verifying angular color shift impact factors as claimed in claim 1, wherein the step of calculating the experimental WB codes corresponding to each gray level of the display panel is based on chromaticity of each gray level at an on-axis view angle of a white image displayed on the display panel in a same principle as deriving a Gamma curve 2.2 when the display panel displays the white image.

3. The method for verifying angular color shift impact factors as claimed in claim 1, wherein each angular color shift is a ratio of an off-axis chroma to an on-axis chroma per view angle.

4. The method for verifying angular color shift impact factors as claimed in claim 1, wherein the maximum gray level is 128.

5. The method for verifying angular color shift impact factors as claimed in claim 1, wherein the maximum gray level is 255.

6. The method for verifying angular color shift impact factors as claimed in claim 1, wherein the first value is one of following numbers: 10, 15, 20, 25, 30, 35, 40, 45, 50, and 55.

7. The method for verifying angular color shift impact factors as claimed in claim 1, wherein the on-axis/off-axis view angle is an included angle between an on-axis/off-axis direction and a normal vector respective to the display panel, ranging from +90 degrees to −90 degrees.

8. The method for verifying angular color shift impact factors as claimed in claim 7, wherein values of the off-axis view angle comprise ±15 degrees and ±30 degrees.

9. The method for verifying angular color shift impact factors as claimed in claim 7, wherein values of the off-axis view angle comprise ±45 degrees and ±60 degrees.

10. A method for improving angular color shifts, comprising following steps:

configuring a white balance (WB) code to one of following WB conditions:

maintaining gray levels of green and blue subpixels while a gray level of a red subpixel is downgraded;

maintaining gray levels of red and blue subpixels while a gray level of a green subpixel is downgraded; and maintaining a gray level of a blue subpixel while gray levels of red and green subpixels are downgraded;

measuring, at an on-axis view angle of a display panel under one of the configured WB conditions, brightness levels and chromaticities of a white image displayed on the display panel;

calculating experimental WB codes corresponding to each gray level of the display panel;

calculating, according to the experimental WB codes, experimental tristimulus values at the on-axis view angle and an off-axis view angle of the display panel;

calculating, based on the experimental tristimulus values, chromas corresponding to each view angle when the display panel displays an image; and calculating and outputting the angular color shifts corresponding to each view angle when the display panel displays the image.

11. The method for improving angular color shifts as claimed in claim 10, wherein the step of calculating the experimental WB code corresponding to each gray level of the display panel is based on chromaticity of each gray level at an on-axis view angle of a white image displayed on the display panel in a same principle as deriving a Gamma curve 2.2 when the display panel displays the white image.

12. The method for improving angular color shifts as claimed in claim 10, wherein each angular color shift is a ratio of an off-axis chroma to an on-axis chroma per view angle.

13. The method for improving angular color shifts as claimed in claim 10, wherein the step of configuring the WB code to one of the WB conditions comprises:

downgrading the gray levels of the red and green subpixels by a range of 1 to 50 levels.

14. The method for improving angular color shifts as claimed in claim 13, wherein the first value is one of following numbers: 10, 15, 20, 25, 30, 35, 40, 45, 50, and 55.

15. The method for improving angular color shifts as claimed in claim 10, wherein the on-axis/off-axis view angle is an included angle between an on-axis/off-axis direction and a normal vector respective to the display panel, ranging from +90 degrees to −90 degrees.

16. The method for improving angular color shifts as claimed in claim 15, wherein values of the off-axis view angle comprise ±15 degrees and ±30 degrees.

17. The method for improving angular color shifts as claimed in claim 15, wherein values of the off-axis view angle comprise ±45 degrees.

18. The method for improving angular color shifts as claimed in claim 15, wherein values of the off-axis view angle comprise ±60 degrees.

19. The method for improving angular color shifts as claimed in claim 10, wherein a maximum gray level of the display panel is 128.

20. The method for improving angular color shifts as claimed in claim 10, wherein a maximum gray level of the display panel is 255.

* * * * *